United States Patent [19]

Lloyd

[11] 4,326,691

[45] Apr. 27, 1982

[54] MUSIC HOLDER

[76] Inventor: Bert A. Lloyd, 1756 Tamarind Ave., Los Angeles, Calif. 90028

[21] Appl. No.: 92,699

[22] Filed: Nov. 9, 1979

[51] Int. Cl.[3] ..... G10G 5/00

[52] U.S. Cl. ..... 248/443; 248/441 A; 248/441 C

[58] Field of Search ..... 248/441 A, 443, 441 C

[56] References Cited

U.S. PATENT DOCUMENTS

| | | | |
|---|---|---|---|
| 603,568 | 5/1898 | Lundquist | 248/443 |
| 608,438 | 8/1898 | Bye | 248/443 |
| 857,504 | 6/1907 | Waldteufel | 248/443 |
| 1,400,217 | 12/1921 | Horger | 248/441 A X |
| 1,897,799 | 2/1933 | Haight | 248/443 |
| 2,234,086 | 3/1941 | Rosebraugh | 248/443 |
| 2,514,068 | 7/1950 | Johnston | 248/443 |
| 2,558,768 | 7/1951 | McCormick | 248/231 |
| 3,544,056 | 1/1968 | Berquist | 248/443 |
| 3,809,352 | 5/1974 | Mathias | 248/441 A X |
| 3,851,847 | 12/1974 | Hinkley | 248/231 |
| 3,946,980 | 3/1976 | Tamarkin | 248/443 |
| 3,948,476 | 4/1976 | Kuniyosi | 248/443 |

FOREIGN PATENT DOCUMENTS

| | | | |
|---|---|---|---|
| 174881 | 12/1916 | Canada | 248/443 |

*Primary Examiner*—William H. Schultz

*Attorney, Agent, or Firm*—Bruce A. Jagger

[57] ABSTRACT

A music holder which has a foot designed to be mounted elastically against the machine heads of a guitar and a leg which receives musical reference material between two spaced apart plates in such a location that the reference material is securely positioned in plain view of the musician and is generally concealed from an audience viewing the face of the guitar.

2 Claims, 4 Drawing Figures

MUSIC HOLDER

This invention relates to a music holder, more particularly, this invention relates to a music holder which is particularly adapted for use with a stringed instrument, and more particularly for use with a guitar.

Previously considerable difficulty had been experienced in providing a satisfactory music holder for use with guitars, particularly where the guitar is being used in public performances. Public performances at which guitars are played are usually of such a nature that the use of a music rack would substantially detract from the entertainment value of the performance. The performers, however, occasionally have need of some reference material. The reference material must be positioned so that it can be seen at a glance by the performer without the audience becoming aware of its presence, and it must be positioned so that it does not interfer with the playing of the musical instrument. Previously, considerable difficulty had been experienced in satisfying these requirements.

According to the present invention a music holder is provided which is adapted to be mounted releasably against the machine heads of a guitar so that the music projects outwardly behind the guitar from the location of the machine heads at such an angle that it is readily visible to the performer who is holding the guitar but is not visible to the members of the audience who are viewing the face of the guitar. In general, the size of the music holder is such that it is concealable behind the portion of the guitar to which the machine heads are mounted. The music holder is provided with a generally flat base or foot which is adapted to rest against the machine heads. The foot or base is generally held in position against the machine heads by means of some elastic material such as an elastic band or bands which mount on the machine heads without interfering with their operation. Preferably, substantially all of the music holder is constructed of transparent material so that if a portion of it does become visible to the audience it is not readily noticeable. The guitar is frequently moved around during a performance and is sonetimes jerked rapidly so that the musical reference material which is held by the music holder must be securely mounted to the holder. In general, it is preferred to sandwich the reference material in a narrow elongated space or slot between two plates so that it will be securely held even though the guitar is moved abruptly. At least the top plate should be transparent with as few edges as possible within the viewing area so that information on the reference material is not blocked from view. The use of a transparent plate which is substantially unbroken in the viewing area, except along the edge where the reference material is inserted into the slot, is generally preferred.

In general, the music holder, according to the present invention, includes a generally planner foot or base from which a holding leg projects outwardly. The planner base is adapted to rest against the machine heads of a guitar or other musical instrument which defines a generally plannerly arranged support area. The reference material holding leg projects generally outwardly at an approximately perpendicular angle which, if desired, may be adjustable to accommodate various playing and concealment requirements. One preferred form of the music holder is that wherein it is generally L-shaped. The foot of the L rests on the machine heads of a guitar and the body or leg of the L projects outwardly in an approximately normal direction to the foot. The form of the music holder may be altered slightly so that it is generally T-shaped, if desired.

BRIEF DESCRIPTION OF THE DRAWINGS

Referring to the drawings for the purposes of illustration and not limitation there is shown.

Figure 1:
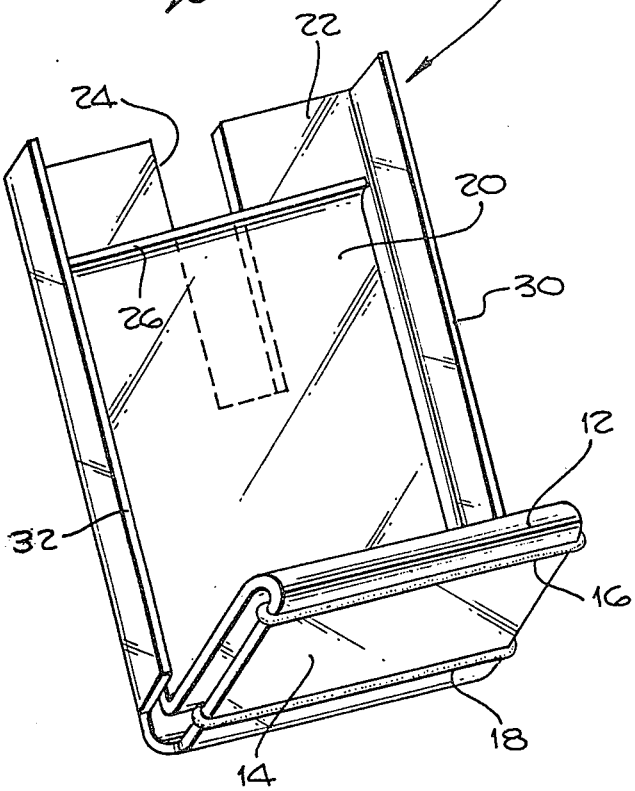
FIG. 1, a perspective view of a preferred embodiment of the invention.
Figure 3:
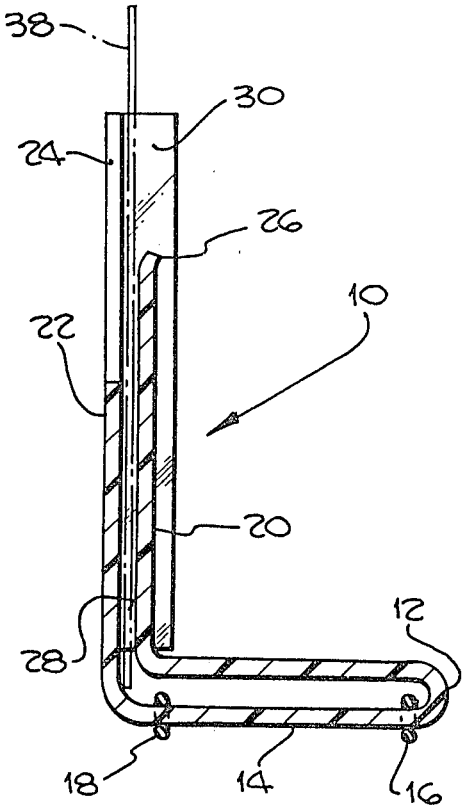
FIG. 3, a cross-sectional view taken along line 3—3 in FIG. 2.
Figure 2:
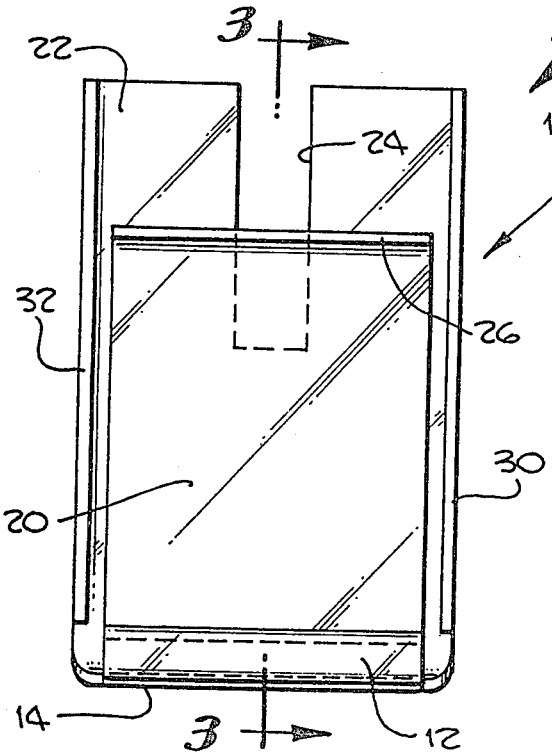
FIG. 2, a front elevational view of the embodiment illustrated in FIG. 1.

Referring particularly to the drawings there is illustrated generally at 10 a music holder which has a generally L-shaped configuration. Music holder 10 includes a foot or support member 12 which has a generally flat surface 14 which is adapted to rest on machine heads on the back side of a guitar. Foot 12 is adapted to be secured to the desired location by means of first elastic cord 16 and second elastic cord 18. Elastic cords 16 and 18 are adapted to be elastically secured to the machine heads of the guitar. When so secured, the elastic cords do not interfer with the tuning or playing of the guitar. The elastic cords 16 and 18 and the foot 12 do not interfer with the operation of the guitar but do mount a leg or holder member composed of a front plate 20 and a back plate 22 in such a position that it is readily observable by a musician who is playing the instrument. The front plate 20 is generally transparent and covers the music or reference material received in the holder from edge to edge in at least one direction so as to provide an unobstructed view of the reference material. The back plate 22 is generally of sufficient size to support the reference material in its entirety so that movement of the guitar does not cause fluttering or flexing of the reference material so as to expose it to the audience or render it unreadable by the musician. Back plate 22 is provided with a notch 24 which is large enough to permit the human finger to be inserted so as to grasp the reference material for insertion or removal purposes. Front plate 20 is provided with an acurate edge 26 at its outer transverse edge. The outward flare of acurate edge 26 facilitates insertion of reference material. Front plate 20 is preferably somewhat shorter in length than the back plate 22 so as to facilitate grasping the reference material which is contained within the holder. A space or slot 28 is provided between the spaced apart front and back plates 20 and 22, respectively, which is large enough to hold several cards or sheets, yet is narrow enough so that one card or sheet is securely held, if only one item of reference material is inserted in the slot 28. Backplate 22 is provided with a first flange 30 and second flange 32 along opposite longitudinal edges thereof. Flanges 30 and 32 prevent reference material which is received in slot 28 from slipping out of the edges of the slot 28.

Figure 4:
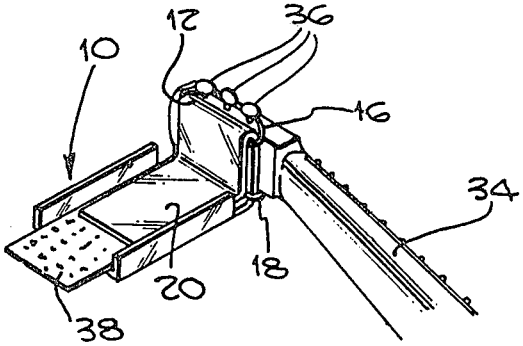
FIG. 4, a perspective view illustrating the embodiment of FIG. 1 mounted in operative position against the machine heads of a guitar.

Referring particularly to FIG. 4, there is illustrated a portion of a guitar neck 34 to which is mounted machine heads 36 in a conventional manner. The machine heads are conventionally mounted on the back side of the guitar where they are largely out of the view of the audience while the instrument is being played. The most rearwardly projecting portions of machine heads 36 define a plane. The flat surface 14 of foot 12 rests against the most rearwardly projecting portions of machine heads 36 so that foot 12 generally extends parallel to the plane which is defined by the most rearwardly protecting portions of machine heads 36. A card 38 which contains reference material for the use of the musician who is playing the instrument is received in music holder 10.

In general, foot 12 should be proportioned so that it is substantially concealable behind the guitar. In one embodiment foot 12 has dimensions of four inches by two inches with back plate 22 having dimensions of four inches by three and one half inches. The longitudinal dimension of front plate 20, in the embodiment just described, is four inches with the transverse length measured along acurate edge 26 being three and one half inches.

Music holder 10 is conveniently constructed by selecting a continuous sheet of transparent thermoplastic material, heating it to its softening point and then bending and folding it into the desired configuration.

What has been described of preferred embodiments in which modifications and changes may be made without departing from the spirit and scope of the accompanying claims.

What is claimed is:

1. A generally transparent generally L-shaped music holder for stringed instruments which have machine heads comprising:

a generally flat foot member extending in a first direction and being adapted to being releasably mounted to a stringed musical instrument in a location which is generally concealed from an audience while the instrument is being played;

elastic means for releasably mounting said foot member against the machine heads of a stringed instrument;

a leg member extending in a second direction approximately normal to said first direction, said leg member including a back plate and a face plate spaced apart in generally parallel relationship to receive a generally flat sheet of music therebetween, said back plate extending further in said second direction than said face plate and having a notch therein extending toward said foot member, whereby grasping a sheet of music received between said plate is facilitated, said face plate having an arcuate outer transverse edge remote from said foot member permitting easy insertion of said sheet of music between said plates, said leg member including flanges positioned to generally block the removal of said sheet of music in a transverse direction.

2. A generally transparent generally L-shaped music holder of claim 1 wherein said foot member and said leg member are constructed from a single piece of transparent thermoplastic material.

* * * * *